United States Patent [19]

Peter

[11] 4,208,993

[45] Jun. 24, 1980

[54] METHOD AND APPARATUS FOR MONITORING THE OPERATION OF AN OXYGEN SENSOR

[75] Inventor: Cornelius Peter, Stuttgart, Fed. Rep. of Germany

[73] Assignee: Robert Bosch GmbH, Stuttgart, Fed. Rep. of Germany

[21] Appl. No.: 878,506

[22] Filed: Feb. 16, 1978

[30] Foreign Application Priority Data

Feb. 21, 1977 [DE] Fed. Rep. of Germany ..... 2707383

[51] Int. Cl.[2] ..... F02M 7/00

[52] U.S. Cl. ..... 123/119 EC; 123/32 EE; 60/276

[58] Field of Search ..... 123/119 EC, 32 EE; 60/276, 285

[56] References Cited

U.S. PATENT DOCUMENTS

| | | | |
|---|---|---|---|
| 3,939,654 | 2/1976 | Creps | 60/285 |
| 4,023,357 | 5/1977 | Masaki | 123/119 EC |
| 4,030,462 | 6/1977 | Sasayama et al. | 123/32 EE |
| 4,040,394 | 8/1977 | Wahl et al. | 123/119 EC |
| 4,040,408 | 8/1977 | Kraus et al. | 123/32 EE |
| 4,083,337 | 4/1978 | Hattori, et al. | 123/119 EC |
| 4,112,893 | 9/1978 | Anzai | 123/119 EC |
| 4,119,070 | 10/1978 | Asano | 123/119 EC |
| 4,121,554 | 10/1978 | Sueishi | 60/276 |
| 4,122,811 | 10/1978 | Bowler et al. | 60/285 |

*Primary Examiner*—Charles J. Myhre
*Assistant Examiner*—R. A. Nelli
*Attorney, Agent, or Firm*—Edwin E. Greigg

[57] ABSTRACT

A method and apparatus for detecting when the internal resistance of an oxygen sensor is too high for useful signal processing. A reference voltage is applied to the sensor signal to generate a test voltage which is compared with two different threshold voltages. The three possible magnitude states of the test voltage with respect to the thresholds cause the comparator output signals to define logical conditions which are processed by logical gating circuitry to inhibit a timing circuit which otherwise would switch fuel mixture preparation from sensor-controlled operation to open-loop, direct control after a period of time.

18 Claims, 11 Drawing Figures

METHOD AND APPARATUS FOR MONITORING THE OPERATION OF AN OXYGEN SENSOR

BACKGROUND OF THE INVENTION

The invention relates to the fuel management in internal combustion engines. More particularly, the invention relates to a method and an apparatus for use with a fuel preparation system in which an oxygen sensor in the exhaust system generates signals related to the exhaust gas composition. The fuel preparation system may be a carburetor, a fuel injection system of any type or some other fuel mixture preparation system. The method and apparatus according to the present invention provide continuous monitoring of the operational readiness of the exhaust gas sensor and initiate a switchover from closed-loop to open-loop control and back depending on the operational readiness of the sensor.

This exhaust gas sensor, usually an oxygen sensor, and sometimes referred to as a λ-sensor, is used to provide the actual variable in a preferably closed-loop control system in which it is placed in the exhaust system and generates an electrical signal which is then used for a comparison with a reference value in order to provide closed-loop, i.e. feedback control, of the fuel mixture. The closed-loop control permits a very precise mixture preparation which is desirable to attain the most efficient use of fuel and an exhaust gas as free from toxic or noxious components as possible. The mixture preparation system normally contains a provision permitting operation in open-loop mode, i.e. when no control signal from the sensor can be discerned or if the signal is not adequate for use as a control signal. In such a case, the fuel mixture generator operates on a simple forward control, i.e. it meters out fuel on the basis of the prevailing position of control levers or mechanisms to as to prepare an average value of the fuel mixture ratio in overall dependence on the engine operation, for example load and engine speed. The closed-loop control is possible only for a properly functioning λ-sensor. The λ-sensor may fail to give a usable signal for a variety of reasons; in particular it will not be able to generate a usable output signal if its temperature is too low. Similarly, a signal may fail to be obtained if the sensor cable is broken or short-circuited. The signal from the sensor may also be erroneous and unusable for closed-loop control due to aging, a fracture of the ceramic envelope or chemical poisoning. In order to prevent engine malfunction when one of these sensor conditions obtains, it is necessary to install monitoring systems which respond to any of the aforementioned sensor malfunctions and which initiate a switchover to direct forward control until such time as the λ-sensor again becomes operational.

OBJECT AND SUMMARY OF THE INVENTION

It is thus a principal object of the present invention to provide a method and an associated apparatus for monitoring the operational readiness of a λ or oxygen sensor used in the fuel management of an internal combustion engine. It is a further object of the present invention to provide a method and an apparatus for indicating one of a variety of operational modes of the λ-sensor and to generate a suitable control signal for placing the fuel mixture preparation system into the required open-loop or closed-loop state.

It is a further object of the invention to provide an apparatus which is simple in construction. It is yet another object of the invention to provide an apparatus which permits a utilization of the λ-sensor signal even during the warm-up phase of the sensor and in spite of its then very high internal resistance.

Yet another object of the invention is to provide an exhaust gas sensor monitor which does not require a shifting of the reference value or a regulated current to be introduced into the sensor.

These and other objects are attained according to the present invention by providing that a constant reference voltage is connected in opposition to the sensor voltage. The invention then further provides two comparator circuits with different threshold values, both connected to a part of the input circuit in which the reference voltage and the sensor voltage are joined. The output states of the comparator circuits are then fed into various logical coupling circuits which ultimately generate control signals which switch the fuel mixture preparation system from a closed-loop mode to a direct, open-loop mode. The method and apparatus of the present invention are directed to the recognition of three different sensor states and their associated logical states within the comparator output network. The presence of essentially digital signals that identify the sensor condition permits the use of digital circuitry for defining a monitoring interval and other processing. It is a particular feature of the present invention that no adjustment of any kind is required within the region of the logical processing circuitry. Therefore the entire processing, including the generation of the monitoring interval, is extremely precise and not subject to aging or temperature drifts. The circuit according to the present invention is thus highly immune to interference and may be embodied as a simple integrator circuit inasmuch as it does not require high-valued capacitors not does it need short signal propagation times.

It is a further advantage of the invention that the apparatus responds to both negative and positive-going edges of the sensor signal and the closed-loop operation will thus be initiated whether the basic fuel mixture setting is rich or lean.

The invention will be better understood as well as further objects and advantages thereof become more apparent from the ensuing detailed description of exemplary embodiments taken in conjunction with the drawing.

DESCRIPTION OF THE PREFERRED EMBODIMENTS

The basic principle of a fuel management system which employs an exhaust gas or so-called λ-sensor is well known and will only be discussed in major outlines.

Figure 1:
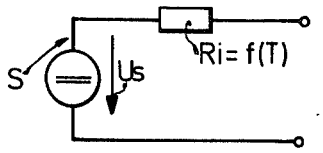
FIG. 1 is an equivalent circuit diagram of an oxygen sensor.
Figure 2:
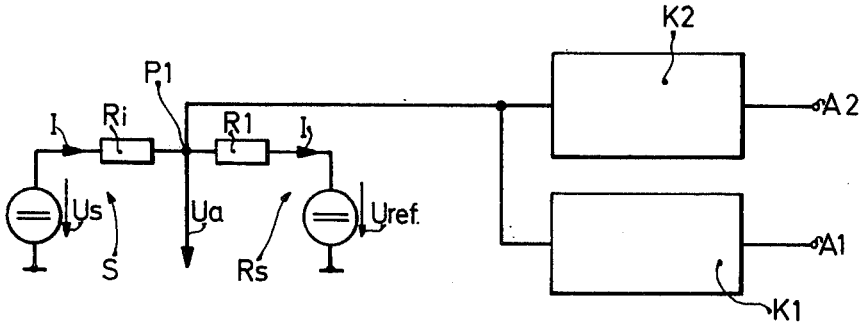
FIG. 2 is a block diagram of a processor circuit for the λ-sensor signal.

An oxygen sensor or a so-called λ-sensor disposed in the exhaust gas operates on the principle of ionic conduction through a solid electrolyte which generates an abrupt voltage shift if one of its surfaces is exposed to atmosphere and the other undergoes a transition from an excess to a shortage of oxygen. The point of transition is the point at which the air factor λ is defined to be unity. It is known that λ-sensors of this type do not generate a usable signal until they have reached a fairly high operating temperature. This is due to that fact that when the sensor is cold, its internal resistance is extremely high and does not permit the generation of a clear voltage transition and a usable signal. The normal output signal from the sensor is of relatively low value when the air factor λ is greater than 1 (lean mixture) and is relatively high when the air factor λ is less than 1 (rich mixture). The output voltage is subject to drastic changes during the warm-up phase of the engine and of the sensor due to the very high temperature dependence of the internal sensor resistance. FIG. 1 is an equivalent circuit of the λ-sensor shown as a voltage source with a temperature-dependent internal resistance Ri. It is a particular feature of the present invention that the output signal from the λ-sensor may be used even when the sensor temperatures are relatively low, and their interpretation is made in algebraic, i.e. digital, form so that the λ-sensor may be used for mixture control even under normally very unfavorable temperature conditions. The particular mixture preparation systems may be fuel injection systems, either intermittent or continuously operating, or they may be carburetors or some other systems which generate and deliver a combustible fuel-air mixture to an internal combustion engine. The output signal from the exhaust sensor, i.e. λ-sensor, is used to correct the mixture of the fuel mixture fed to the engine. If the λ-sensor is incapable of generating a usable control signal for whatever reason, the entire fuel mixture preparation system must be switched over to a simple forward direct control in which the various operational states of the engine result in an average fuel mixture ratio without any feedback information, i.e. any feedback signal from the exhaust channel of the engine. An open-loop, direct control is incapable of monitoring the actual mixture preparation and is thus less desirable than closed-loop control. For this reason, it is desirable to switch back to a closed-loop feedback control as soon as an output signal from the λ-sensor is again available. The signal processing circuitry of the present invention uses digital, i.e. logically compatible output signals and defines three separate operational states of the λ-sensor signal. The basic principle of the invention is illustrated in FIG. 2 in which there is shown a processor circuit whose output carries logical switching signals. The basic principle of the invention derives from the possibility to obtain a usable sensor signal even when the sensor temperatures are low (approximately 200° to 250° C.) and the internal resistance is between 5 and 20 MOhm. The various operational states of the λ-sensor which the present invention defines are these:

| | |
|---|---|
| 1. Sensor too cold | Ri > 15 MOhm (or λ = 1) |
| 2. λ > 1 | Ri ≦ 15 MOhm |
| 3. λ < 1 | Ri ≦ 15 MOhm |

In order to obtain logical output signals from the circuit of FIG. 2 which correspond to the above-listed states, the reference voltage of the first comparator K1 will have a value which will be an amount ΔU less than $U_{ref}$ and the reference voltage of the comparator K2 will have the value $U_{ref}+\Delta U$. In the basic circuit of FIG. 2, two voltage sources are placed in parallel, the first of the voltage sources being the λ-sensor S having an output voltage $U_s$ and a temperature-dependent internal resistance Ri whereas the second voltage source $R_s$ has a reference voltage $U_{ref}$ which is passed through a separate or internal resistor R1. The voltage Ua generated at the junction P1 is a test voltage fed to the inputs of both comparators K1, K2 and is processed there with possibly different results due to the different reference voltages in the two comparators. The outputs A1 and A2 of the two comparators will carry the following logical signals for the various sensor conditions.

| Sensor Condition | A1 | A2 |
|---|---|---|
| cold or λ0 =1 | 1 | 0 |
| warm and λ 22 1 | 0 | 0 |
| warm and λ < 1 | 1 | 1 |

The voltages actually present at the various points of the circuit of FIG. 2 can be calculated according to formulas which will now be derived. Any numerical values given will of course be only exemplary and will refer only to a particular hypothetical case. The connection of the two voltage sources S and Rs in FIG. 2 results in the following general formulas:

$$U_s - U_{ref} - I(R_i + R_l) = 0 \quad (1)$$

$$I = \frac{U_s - U_{ref}}{R_i + R_l} \quad (2)$$

$$U_a = U_{ref} + I \cdot R_l \quad (3)$$

From these three equations one obtains $$U_a = U_{ref} + \frac{R_l}{R_i + R_l} \cdot (U_s - U_{ref}) \quad (4)$$

As a particular example, let it be assumed that when the sensor is operational and the mixture is lean (λ>1) the sensor voltage $U_s$=100 mV whereas when the mixture is rich, the sensor voltage $U_s$=900 mV. Let it be assumed as an example that the other variables are as follows:

$U_{ref}$=500 mV $R_1$=1 MOhm $R_i$=15 MOhm.

In that case the voltage $U_a$ fed to the comparators for a lean mixture ($U_s$=100 mV) will be $U_a$=525 mV whereas for a rich mixture ($U_s$=900 mV), the input voltage to the comparator will be $U_a$=475 mV. In this particular numerical example, the threshold difference will be 50 mV and ΔU will suitably be 25 mV. As noted above, the assumed internal sensor resistance was $R_i$=15 MOhm. If this resistance is actually smaller, the two voltages fed to the comparators and respectively related to lean and rich mixture will become progressively more different. For example, if the assumed internal sensor resistance $R_i$ is 1 MOhm, the voltage $U_a$ will be 700 mV for a rich mixture and 300 mV for a lean mixture. If the two reference voltages in the comparators K1 and K2 are adjusted respectively to 525 mV and 475 mV, the differences in the input voltage $U_a$ will be reliably recognized. Such recognition will take place up to an approximate limit of 15 MOhm for the internal sensor resistance. The sensitivity of the circuit could easily be increased beyond this limit by a suitable construction of the comparators but not without some additional complication of the input stages of the comparators. If the λ-sensor is warmed up and is recognizing a rich mixture (λ<1), the voltage $U_a$ will actually be higher than the reference level of both comparators so that both outputs A1 and A2 will be carrying a logical 1 signal (high) whereas a lean mixture will cause both outputs A1 and A2 to go low (logical 0). Only if the internal resistance of the λ-sensor goes beyond the previously assumed value of $R_i$=15 MOhm, does the voltage $U_a$ assume values in which one comparator responds whereas the other does not and the dissimilarity of the comparator output signals reflects the fact that the sensor is cold and exhibits a high internal resistance. A similar condition would be obtained however when the sensor is signaling a stoichiometric state where λ is exactly equal to 1. A processing circuit which interprets and evaluates the signals present at the outputs A1 and A2 will be described below. However, a detailed circuit diagram of the comparator circuit of FIG. 2 will now be described with the aid of FIG. 3.

Figure 3A:
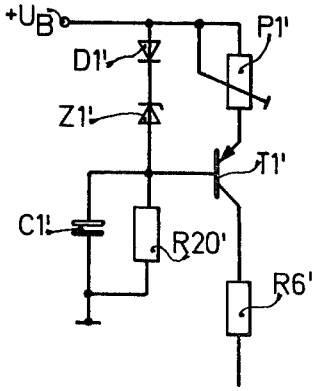
FIG. 3A is an illustration of substitute embodiment of a current source for the circuit of FIG. 3.
Figure 3:
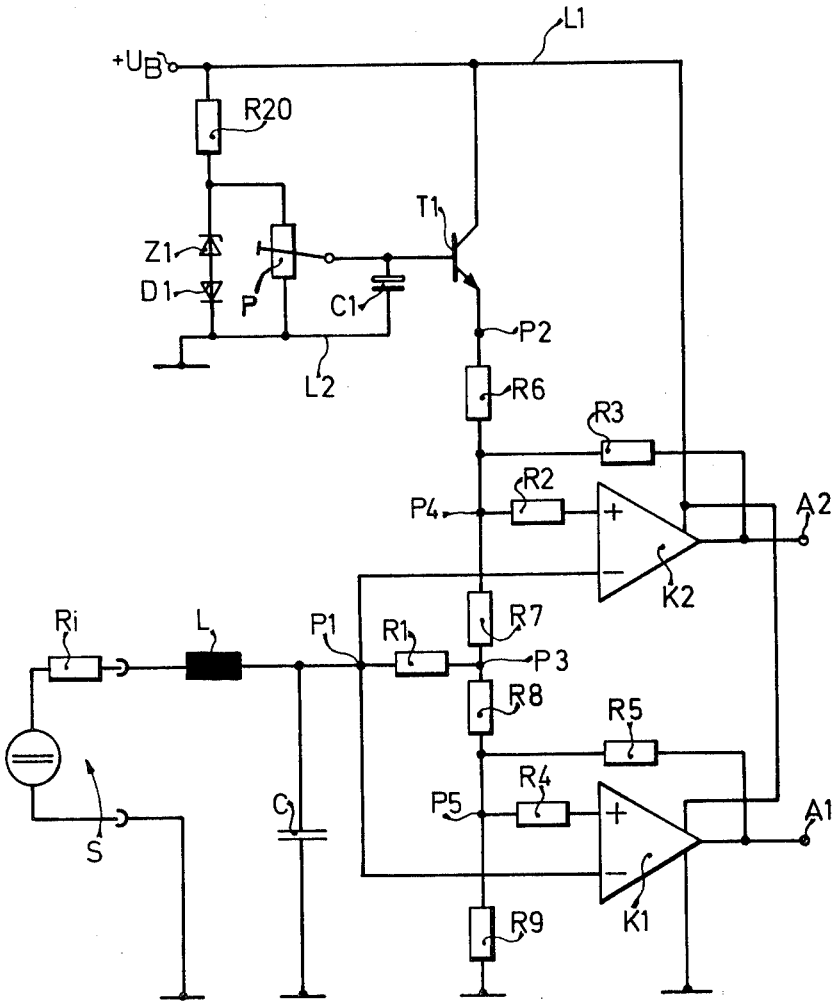
FIG. 3 is a detailed circuit diagram of the processor circuit of FIG. 2.

A principal component of the comparator circuit illustrated in FIGS. 2 and 3 is a symmetric voltage divider consisting of resistors R6, R7, R8, R9. This voltage divider serves to supply the reference voltages fed to the non-inverting inputs of the comparators K1 and K2 as well as the reference voltage $U_{ref}$ which is opposed to the sensor potential. The voltage at the circuit point P2 is generated by a temperature-compensated voltage or current source illustrated in FIG. 3*a*. The latter includes a transistor T1 whose collector is connected to the voltage supply line L1 carrying battery voltage $U_B$ and whose emitter is the circuit point P2. A base voltage divider consisting of a resistor R20, a Zener diode Z1 and a further diode D1 is provided between the positive and negative supply lines. Connected in parallel to the two diodes is an adjustable voltage divider, for example a potentiometer P, whose tap is connected to the base of the transistor T1 in parallel with a capacitor C1. The comparators K1 and K2 may be formed by operational amplifiers, connected as Schmitt triggers. The input resistors R2 and R4 leading to the non-inverting inputs of the comparators compensate for the voltage drop which the input currents generate across the resistor R1. The resistor R1 in FIG. 3 is equivalent to the resistor R1 of FIG. 2. The reference voltage $U_{ref}$ occurs at the circuit point P3 and is transmitted via the resistor R1 to the circuit point P1 where the λ-sensor S with its internal resistance $R_i$ is connected via an LC member. The circuit point P1 is directly connected to the inverting inputs of the comparators K1 and K2.

In a practical exemplary circuit, the values of the resistors were as follows:

R1, R3, R5=1 MOhm
R2, R4=2 MOhm
R6, R9=1 KOhm
R7, R8=47 Ohm.

When the foregoing resistor values are used, one obtains a reference voltage of $U_{ref}$=500 mV at the point P3, $U_{ref}+\Delta U$=525 mV at the point P4, and $U_{ref}-\Delta U$=475 mV at the point P5 while the voltage source of the emitter of transistor T1 (Point P2) delivers a stabilized voltage of 1 volt.

As already mentioned, it is possible to make the thresholds difference, which is assumed here to be 50 mV, to be even smaller if the sensitivity of the operational amplifiers is increased, for example by using field effect transistors at the inputs of the operational amplifiers. In that case, it is possible to increase the value of R1. By lowering the difference in the threshold voltages, the processing circuit according to the present invention can sense the operational status of the λ-sensor even when the internal sensor resistances are greater than 15 MOhm. In any case, it is a significant advantage of the invention that when the engine is being started, the switchover of the system to closed-loop automatic control takes place as soon as the λ-sensor reaches its operational temperature which in this case is a temperature permitting the comparators K1 and K2 to reliably monitor the sensor operation. This will be true when both comparator signals indicate the logical states 1 or 0.

Instead of using a temperature-compensated voltage source, it is possible to use a current source as illustrated in FIG. 3*a*. The current source includes a transistor T1′ whose emitter is connected through an adjustable resistor P1′ to the voltage supply line $U_B$ while its collector is connected to the resistor R6. The voltage divider circuit is inversed in this case; the diode D1′ is connected to the voltage supply by its anode and lies in series with a Zener diode Z1′ whose anode is connected to the base of the transistor T1′. The base is connected to ground via the parallel connection of a capacitor C1′ and a resistor R20′. The transistor thus places a constant temperature compensated current into the reference voltage divider circuitry.

There will now be describd a processor circuit for processing the output signals occurring at the points A1 and A2. This processor circuit is constructed on the principle that the normal sensor operation is signified by the fact that both output signals A1 and A2 carry the same signal which will be a high logical signal (logical 1) when the mixture is rich and will be a low logical signal (logical 0) when the mixture is lean. Whenever that state occurs, the signal from one of the comparators may be immediately used for the purpose of closed-loop control as will be described in detail below. The output signal from that comparator can be processed in the usual manner, for example by means of an integrator whose own output, for example, influences the duration of fuel injection control pulses. The processor circuit of FIG. 3 can be adjusted at a single point, all other components being of fixed value. It is a further particular advantage that the warm-up phase requires no change in the threshold voltage and no additional circuitry for generating a bucking voltage for the sensor and still permits the use of the sensor signal during this critical warm-up phase.

Figure 4:
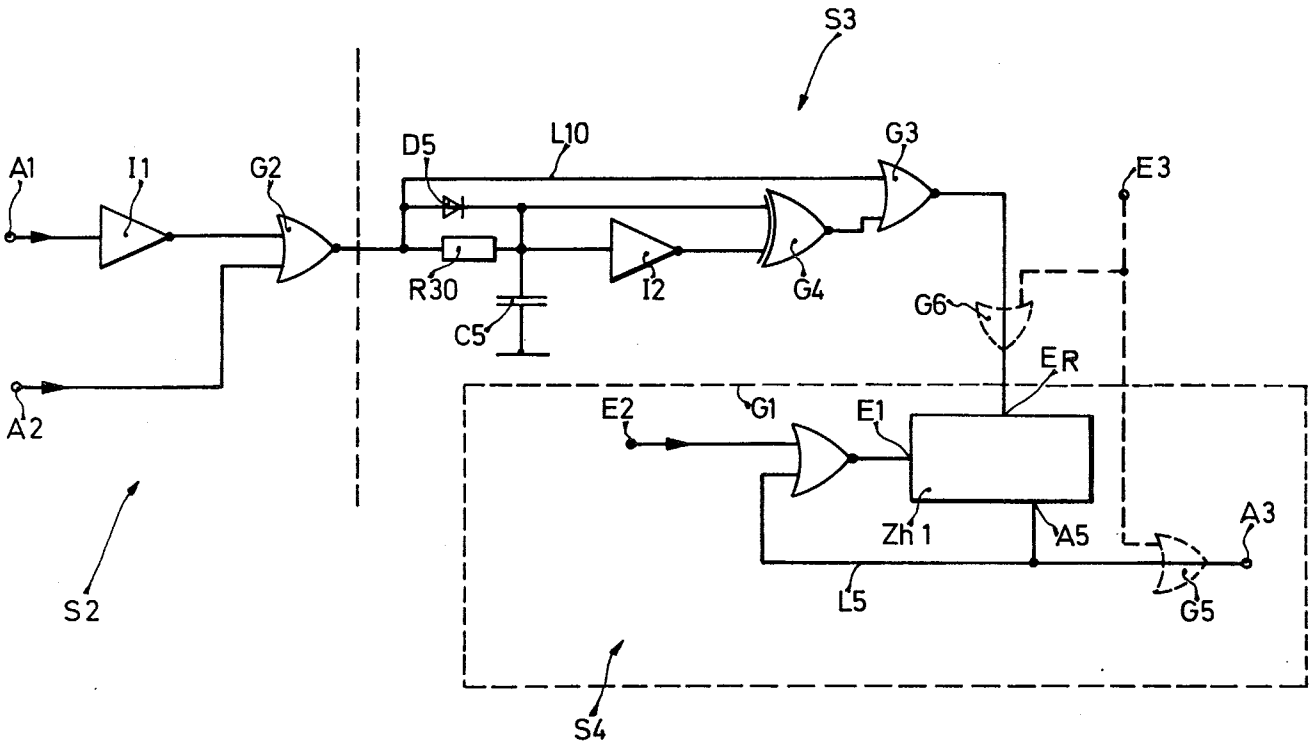
FIG. 4 is a circuit diagram of a first embodiment of a monitor circuit connected behind the processing circuit of FIG. 3.

The sensor monitor circuit which uses the signals from the processor circuit of FIG. 3 is illustrated in FIG. 4 in a first exemplary embodiment. Its output signal, present at the point A3, indicates whether the fuel preparation system is to operate in closed-loop λ control or must be operated in direct forward control. The monitor circuit includes logical connective circuitry S2 for recognizing the sensor state, a subsequent detector circuit S3 and a timing circuit S4 which receives trigger pulses from the detector circuit. If these trigger pulses are absent, the timing circuit will automatically switch the entire mechanism over to open-loop control after the monitoring time period has elapsed.

When an engine is being operated with λ control, the closed-loop control process must be interrupted and simple direct fuel management initiated whenever the λ-sensor signal is unusable and this may be due to a variety of causes. These are:

(a) sensor too cold (no usable signal)
(b) sensor supply cable broken
(c) sensor supply cable short-circuited
(d) continuous rich signal (for example due to aging)
(e) continuous lean signal (for example due to fracture of ceramic shell)
(f) continuous negative voltage (for example due to chemical poisoning of the sensor)

The monitor circuit to be described below is capable of recognizing all of these conditions and to process them in a way so as to generate an output signal which will indicate to subsequent mechanisms whether operation is to take place in open or closed-loop control. The monitor circuit uses the signals present at the outputs A1 and A2 of comparators K1 and K2, respectively. However it should be understood that the monitor circuit would be able to use signals prepared in some other way and not necessarily in the exact manner described above.

In the following table, the three logical states which are related to the various comparator output signals are listed again.

| State | Output A1 | Output A2 | Input Information |
|---|---|---|---|
| 1 | 0 | 1 | no input signal, a), b) |
| 2 | 0 | 0 | sensor voltage 525 mV (rich, d)) |
| 3 | 1 | 1 | sensor voltage 475 mV (lean, c), e), f |

The timing circuit S4 within the monitor circuit of FIG. 4 runs for an adjustable period of time $t_{max}$. If no triggering circuit is received from the detector circuit S3 during that time, the timing circuit alters its output signal, causing subsequent systems to switch from closed-loop to open loop fuel management. However, the timing circuit can cause an immediate return to closed-loop control if a suitable alternation of the sensor signal implies the operational readiness of the λ-sensor.

In the preferred exemplary embodiment of FIG. 4, the timing circuit S4 includes a counter Zh1 whose counting input E1 receives a suitable clock signal. When the apparatus according to the present invention is used in conjunction with a fuel injection system, for example the so-called K-Jetronic system of the Applicant, there is present within that system a source of a 70 Hz clock frequency which is suitable for being applied to the counting input E1. In any case, the counter Zh1 is so constructed that one of its outputs A5 switches, for example to a logical 1 after a period of, for example, 7 or 8 seconds has elapsed, unless a suitable reset pulse has been applied to the rest input $E_R$. If no triggering pulse is received during the monitoring time, i.e. during the time when the counter counts from 0 to the occurrence of a logical 1 at the output A5, the monitor circuit assumes that one of the conditions (a) to (f) has occurred and causes a logically high signal to occur at A3, thereby causing the fuel system to switch over to direct, open-loop control. A feedback line L5 from the output A5 to a NOR gate G1 blocks the admission of the clocking pulse train to the input E2, thereby latching the output state in the direct control mode.

Together with the detector circuit S3, this circuit permits a dynamic evaluation of the sensor signal, i.e. a switchover from the temporary open-loop control back to closed-loop control, if the signal status changes from condition 1 to one of the conditions 2 or 3 in the above table, provided that the state 2 or 3 of the table obtains for at least a time period $t_{min}$ which prevents the admission of high frequency spurious signals.

The logical input circuits of the monitor circuit of FIG. 4 are so constructed as to recognize the logical significance of the input signals from the outputs A1 and A2 in the sense that equal signals are defined to imply the conditions 2 or 3, while different signals on the outputs A1 and A2 imply the circuit state 1 of the table. The decoding circuit S3 then permits a differentiation as to whether the λ-sensor actually operates correctly or if one of the other possible conditions (c) to (f) has taken place.

In the exemplary embodiment of the monitor circuit of FIG. 4, there is included a NOR gate G2 one of whose inputs receives the signal from the output A2 of the comparator K2 and whose other input receives the output signal from the contact A1 via an inverter stage I1. According to Boolean algebra, the output of the NOR gate will be a logical 1 if the input signals A1 and A2 are different, otherwise the output of the gate G2 will be a logical 0.

The subsequent detector circuit S3 has a timing member consisting of a capacitor C5 and a resistor R30 in parallel with a diode D5. The junction of the latter two elements is connected to the output of the NOR gate G2 and to the input of a further NOR gate G3 whose output generates the previously referred-to trigger signal for resetting the counter Zh1. The second input of the NOR gate G3 is connected to the output of an exclusive OR gate G4, both of whose inputs are connected to a junction of the diode D5 and the resistor R30, one of them via an inverter I2. The second electrode of the capacitor C5 is grounded. When the λ-sensor and the associated circuitry are in the state 1 of the above table, the output of the NOR gate G2 will be high (logical 1) i.e. at a relatively positive voltage. The logical 0 level may then be either ground or some negative potential. When the combination of signals at the contacts A1 and A2 changes to indicate the circuit condition 2, the capacitor C5, which had previously been charged to positive voltages, now discharges to ground through the resistor R30 and the NOR gate G2 because the output of the NOR gate G2 carries a low voltage (logical 0). After a passage of time $t_{min}$, defined by the combination C5/R30, the voltage on the capacitor will be equal to the threshold voltage of the subsequent gating circuitry consisting of the inverter I2 and the exclusive OR gate G4. In other words, as the capacitor voltage decreases, the different thresholds in the exclusive OR gate G4 or the inverter I2 temporarily cause the gate G4 to alter its output to a logical 0, at which time the output of the NOR gate G3 goes to a logical 1 which resets the counter Zh1 at its input $E_R$. Accordingly, the output signal of the timing circuit S4 goes to logical 0 and the entire fuel preparation system goes into closed-loop feedback control. If, prior to the expiration of the time $t_{min}$, the input signals for the monitor circuit S2 return to the switching condition 1 (see above table), the discharging of the capacitor C5 stops and the capacitor is rapidly recharged through the diode D5. At the same time, any possible high reset pulse which might reach the NOR gate G3 via the line L10 is blocked because this line will be at high voltage and will prevent any possible high output from the NOR gate G3.

When the system is switched from open-loop to closed-loop control, i.e. from the switching state 1 to one of the states 2 or 3 in the above table, the presence of the delay timing elements C5/R30 which define the delay time $t_{min}$ act as a very effective block for any spurious or noise pulses, especially those of high frequency, which are prevented from erroneously switching the system. The detector circuit S3 does not act to release the reset pulse at the output of the NOR gate G3 until the expiration of the time $t_{min}$. The detector circuit S3 is an edge detector and uses the sensor signal dynamically. For example, if, during normal operation, the λ-sensor periodically switches between a rich signal and lean signal, the output signals A1 and A2 of the comparators also alternate cyclically between the states 2 and 3 of the above table. In that case, the output of the NOR gate G2 of the circuit S2 will always be a logical 0. However, the transition of the signals at the points A1 and A2 into the opposite states is not exactly symmetric due to the difference in the thresholds of the inverter I2 and the NOR gate G2. For this reason, the output of the NOR gate G2 will be high for a very short period of time and will permit the charging of the capacitor C5 via the diode D5. Subsequently, the NOR gate G3 generates the counter reset pulse in the manner described above.

In view of the foregoing it will be appreciated that the monitor circuit of the invention is capable to recognize all of the previously cited conditions (a) to (f) of sensor failure because, when the system remains in the switching stages 2 or 3, the detector circuit S3 does not generate reset pulses for the timing circuit S4.

The switchover from closed-loop control to open-loop control takes place if the counter does not receive a reset pulse during its counting period $t_{max}$. The counter may be a binary counter which has an output A5 which goes high after the counter has counted $2^9$ pulses. If the clocking frequency is 70 Hz, the system will switch over from closed-loop to open-loop control after approximately 7.3 seconds. Thereafter, the high output A5 of the counter holds the counter contents via the NOR gate G1.

The monitor circuit makes possible an external engagement of the system, for example an arbitrary switchover to direct open-loop control when the engine is being operated in downhill operation with fuel cut-off or with full-load enrichment. In order to permit this kind of interaction, the elements shown in dashed lines may be used. For example, the input E3 may receive a logical 1 signal which pulls the output A3 up via the OR gate G5. A second OR gate G6 can then be used to reset the counter Zh1.

Figure 5:
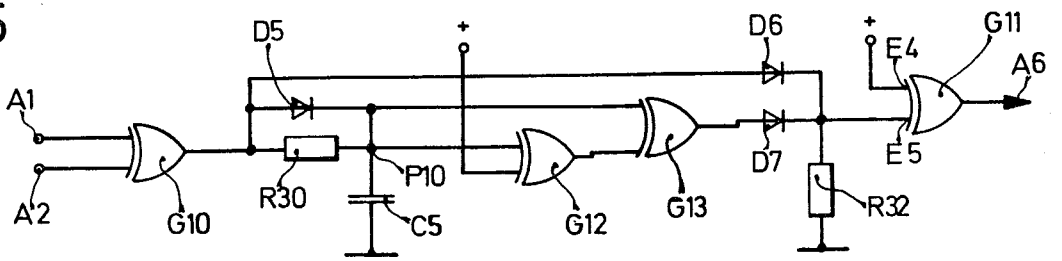
FIG. 5 is a circuit diagram of a second exemplary embodiment of a monitor circuit.

A second exemplary embodiment for sensor monitoring, i.e. edge detection and spurious pulse rejection, may be seen illustrated in FIG. 5. This embodiment contains an exclusive OR gate G10 again receiving the signals from the comparator outputs at points A1 and A2. The output of the exclusive OR gate G10 flows through a diode D6 directly to the input of an exclusive OR gate G11 whose output A6 carries the reset pulse which is fed to the timing circuit S4. The output of the exclusive OR gate G10 is further connected to the previously discussed (see FIG. 4) combination of elements D5/R30/C5 which is responsible for imparting the delay time $t_{min}$ which is used for filtering out spurious pulses. The output of this delay circuit at the point P10 is connected to a further exclusive OR gate G12 whose second input is constantly pulled high by being connected, for example, to the positive battery voltage. The output of the gate G12 is connected to the input of yet another exclusive OR gate G13 whose second input receives the voltage at the point P10. The output of the gate G13 is connected via a diode D7 with the same input of the gate G11 which is already connected directly to the gate G10 through the diode D6. The second input of the gate G11 is held at the high level. In order to obtain well-defined switching states, the variable input of the gate G11 is connected to ground via a resistor R32.

When the various possible switching conditions are examined with reference to the transitions from the state 1 to the states 2 or 3 or, again, the transition between states 2 and 3, it will be seen that the output of the exclusive OR gate G11 always generates a reset pulse if the λ-sensor and the two subsequent comparators K1 and K2 indicate closed-loop control. For this reason, a detailed description of the second embodiment of the monitor circuit according to FIG. 5 will not be given; only the transition from the switching state 1 to one of the switching states 2 or 3 will be so discussed. The exclusive OR gate G10 will have a low output when the input signals are both of the same logical kind and will have a high output signal otherwise. Thus in the switching state 1 of the above table, the output of the exclusive OR gate G10 will be a logical 1 which changes to a logical 0 when the system enters the states 2 or 3 of the table. In that case, the diode D6 blocks, which is one of the necessary conditions for generating a logical 1 at the output A6 because, inasmuch as one input E4 of the exclusive OR gate G11 is always high, the outer input E5 must be low in order that a high output signal may be produced. The gradual decrease of the voltage at the point P10 due to the discharge of the capacitor C5 below the different thresholds defined by the exclusive OR gates G12 and G13 causes the output of the G12 gate to be high for a very short period of time where the other input of the gate G13 still receives a high signal. Viewed another way, the still effective logical 0 from the output of the gate G12 switches the output of the gate G13 to logical 0 so that, when the input signals are different, the exclusive OR gate G11 may generate a high signal.

Figure 6:
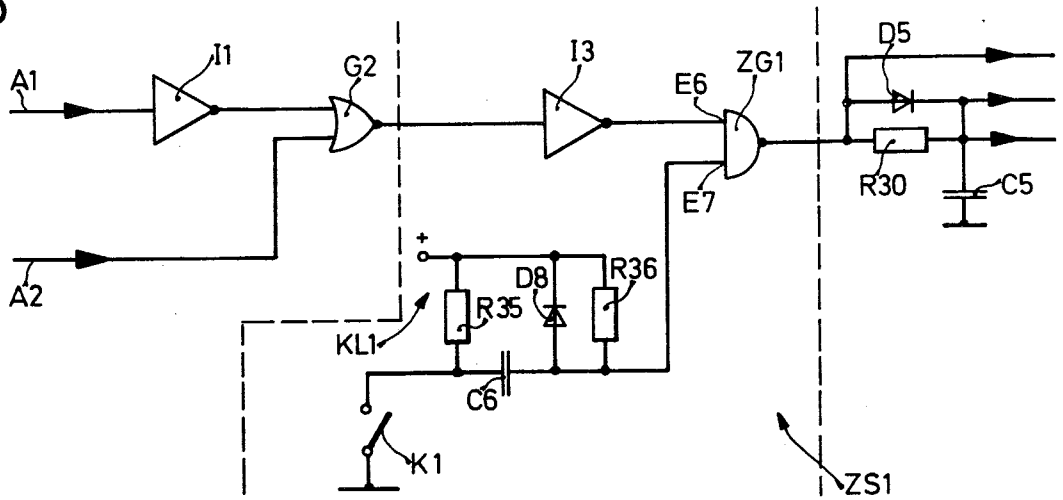
FIG. 6 is a circuit diagram of a circuit which generates independent reset pulses for switching the apparatus over to closed-loop control.

A switchover from direct to closed-loop control is possible only at an occurrence of an edge of the λ-sensor signal. For this reason, it is possible that, when the entire system is being operated at a value substantially different from $\lambda=1$ (for example at $\lambda=0.9$ or $\lambda=1.1$), the sensor will continuously indicate an excessively rich or lean mixture and the entire control system would be hung up in the open loop configuration. This eventuality is prevented by one of two circuits illustrated respectively in FIGS. 6 and 7. In the illustration of FIG. 6, an idling switch K1 at the gas pedal of the engine generates a supplementary logical high reset pulse if the λ-sensor indicates rich or lean mixture. This additional reset pulse is introduced via a supplementary circuit ZS1 consisting of an inverter I3 and an additional gate ZG1 whose input E6 receives the inverted output signal, for example of the monitor circuit S2 of FIG. 4, while the other input E7 receives the pulse which is generated when the gas pedal is released and the idling switch K1 closes. This pulse is transmitted through the circuit combination KL1 consisting of the series connection of a capacitor C6 with the idling switch K1. Both electrodes of the capacitor C6 are connected through resistors R35 and R36 to the source of positive voltage. A diode D8 is connected in parallel with the resistor R36. The output of the supplementary gate ZG1 is then suitably connected to the detector circuit S3, for example of the embodiment illustrated in FIG. 4. The operation of these circuit elements is illustrated in the curves 8*a* to 8*c*. Until the time t1, the sensor output signal illustrated in FIG. 8*a* fluctuates cyclically between high and low value, i.e. between rich or lean mixture. Accordingly, the output of the integrator as illustrated in FIG. 8*b* alternates in sawtooth fashion. Beginning at the time t1, the λ-sensor indicates a lean mixture and the integrator runs to the desired rich stop, i.e. the intended enrichment signal. From this point on, the λ-sensor no longer alters its output and generates no triggering edge so that the system switches the integrator from closed-loop control to open-loop control at the point t2 and begins to supply an average mixture ratio signal. At the time t3, the idling switch is closed and generates a reset pulse, causing the return to closed-loop control so that the integrator continues to run in the direction causing the mixture preparation system to produce a richer mixture and this fact will then be recognized by the λ-sensor which then undergoes its normal cyclic fluctuations. In this manner, the control loop has recaptured the operation of the system.

Figure 7:
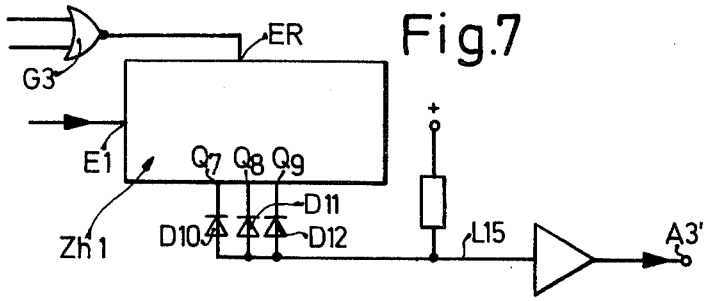
FIG. 7 is a circuit diagram of a second embodiment of the circuit for generating a periodic reset pulse.
Figure 8:
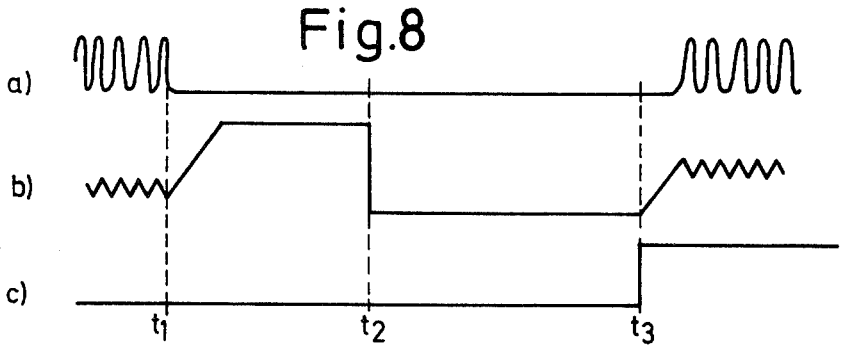
FIG. 8 is a set of curves illustrating the sensor output signal and the associated integrator for the circuit of FIG. 6.
Figure 9:
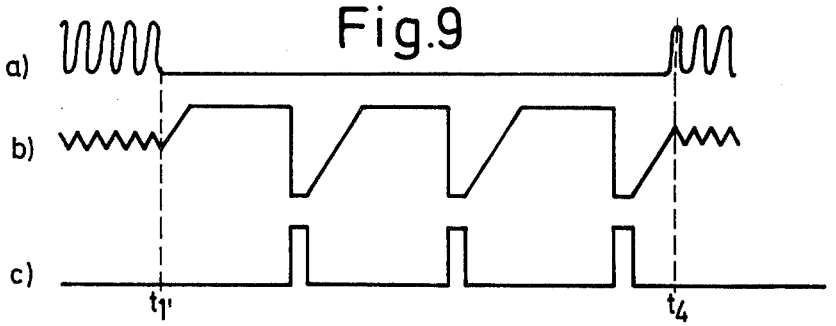
FIG. 9 is a set of curves illustrating the signals occurring in the circuit of FIG. 7.

A second possibility for the periodic and deliberate resetting of the counter is illustrated in FIG. 7. This variant makes use of a particular state of the counter Zh1 which is responsible for the generation of the monitoring time $t_{max}$. A combination of diodes D10, D11 and D12 is used to combine the counter outputs Q7, Q8 and Q9 so that, for example, if the sensor signal fails to alternate and no reset pulses are received, the counter will generate a pulse of duration 0.9 seconds whenever 7.3 seconds have elapsed (in the particular embodiment using a 70 Hz clock rate). This pulse occurring after 7.3 seconds is admitted to the line L15 and is used to set the integrator of the fuel mixture preparation system to open-loop control. A logical 0 at the output A3′ is considered to imply closed-loop control while a logical 1 implies open-loop control. The curves 9*a* to 9*c* illustrate that when the λ-sensor fails according to one of the conditions (c), (d) and (f), the integrator will see-saw between an average output value and the appropriate extreme limit. FIG. 9*a* illustrates the behavior of the sensor output, and FIG. 9*b* shows the output signal of the integrator. FIG. 9*c* illustrates the periodic pulses generated by the counter Zh1. At the time t1′ the sensor signal alternations stop and the integrator, as illustrated in FIG. 9*b*, runs up to its upper limit. The cyclic reset pulses generated by the counter now pull the integrator back to its average control value as illustrated in FIG. 9*c* while at the time t4, the sensor is shown to operate normally and indicates a rich mixture, permitting the integrator to run in the opposite direction.

Figure 10:
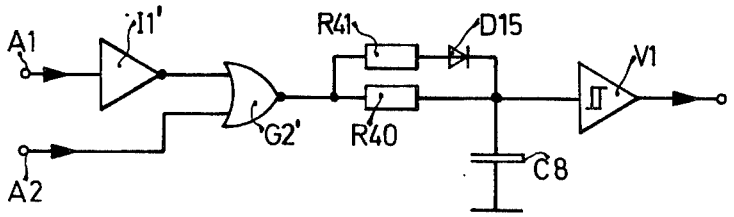
FIG. 10 is a diagram of a simple detector circuit.

If, in some case, it is necessary only to monitor the states (a) and (b) of the various failure modes of the sensor, it is possible to use the simple monitor circuit illustrated in FIG. 10 which can distinguish between the tabular states 1, 2 and 3. As already explained, when the system is in the state 1 of the table, the output of the NOR gate G2′ is a logical 1 which is fed via an asymmetric timing circuit to a subsequent amplifier V1 which includes switching hysteresis. The timing circuit is a grounded capacitor C8 connected to the input of the amplifier V1 which receives the output signal of the NOR gate G2′ via a resistor R40. Connected in parallel with the resistor R40 is the series connection of a further resistor R41 and a diode D15. The values of the resistors R41 and R40 may be such as to be in the ratio of 3:1, giving the desired asymmetry of operation. In the circuit state 1 of the table, the output of the amplifier V1 will be a logical 1 after a rapid charging of the capacitor C8 due to the logical 1 at the output of the NOR gate G2′, and this indicates the conditions (a) and (b). At the occurrence of the states 2 or 3 of the table, the output of the amplifier V1 will be a logical 0 due to the 0 signal received by it from the inverter gate combination I1′,G2′. The asymmetry of the timing circuit acts as a spurious pulse filter.

The foregoing relates to preferred exemplary embodiments of the invention, it being understood that other embodiments and variants thereof are possible within the spirit and scope of the invention.

What is claimed and desired to be secured by letters patent of the United States is:

1. A method for monitoring the operational status of an oxygen sensor located in the exhaust system of an internal combustion engine, said engine including a mixture generator for generating a combustible mixture of fuel and air and a controller for receiving control signals from said oxygen sensor and for controlling said mixture generator, the improvement in said method comprising the steps of:

generating a reference voltage and combining the same with the output voltage from said oxygen sensor to thereby produce a test voltage;

comparing said test voltage with a first and a second threshold voltage in a first and second comparator;

providing logical circuitry to receive the outputs from said first and second comparator and generating logical signals defining a plurality of states of said oxygen sensor; and supplying said logical signals to said controller to thereby switch said controller to operate in closed-loop mode with feedback from said oxygen sensor or in open-loop mode.

2. A method as defined by claim 1, wherein the transition from open-loop to closed-loop control takes place at the occurrence of a transition of a signal varying in correspondence with the output signal from said oxygen sensor.

3. A method as defined by claim 2, wherein the switchover from open-loop control to closed-loop control is delayed with respect to the occurrence of said transition.

4. A method as defined by claim 1, including the step of providing a counter for counting a fixed frequency and for initiating the switchover of said controller at the occurrence at a given counter content unless inhibited by a reset signal from said logical circuitry.

5. An apparatus for monitoring the operational status of an oxygen sensor located in the exhaust system of an internal combustion engine, said engine including a mixture generator for generating a combustible mixture of fuel and air and a controller for receiving control signals from said oxygen sensor and for controlling said mixture generator, and wherein the improvement comprises:

a source of reference voltage including a resistor, connected to said oxygen sensor at a first junction to generate a test voltage;

first and second comparator circuits, having different respective first and second switching thresholds, the inputs of both comparators being connected to said first junction to receive said test voltage;

a detector circuit, connected to the output of said comparator circuits, for generating logical signals related to the magnitude of said test voltage with respect to said first and second switching thresholds;

a timing circuit, for switching said controller from closed-loop control to open-loop control after the expiration of a monitor interval; and said detector circuit is connected to said timing circuit to provide a reset signal thereto in dependence of the output signals from said first and second comparators, to thereby inhibit said timing circuit.

6. An apparatus as defined by claim 5, including a reference voltage divider (R6, R7, R8, R9), the junction (P3) of two of said resistors being connected via a resistor (R1) to said oxygen sensor at a junction (P1) and wherein said first and second comparators are first and second Schmitt triggers (K1, K2) whose inverting inputs are connected to said junction (P1) and whose non-inverting inputs are connected via respective resistors (R2, R4) to different points in said reference voltage divider to thereby receive different reference voltages.

7. An apparatus as defined by claim 5, wherein said detector circuit is a digital circuit so connected to the outputs of said first and second comparators as to provide a logical signal indicating that the outputs of said first and second comparators are equal or unequal.

8. An apparatus as defined by claim 7, wherein said detector circuit is an exclusive OR gate.

9. An apparatus as defined by claim 7, wherein said detector circuit is a NOR gate one of whose inputs receives signals from said first comparator via an inverter.

10. An apparatus as defined by claim 5, wherein said detector circuit includes a monitor circuit (S2) with at least two inputs, respective ones of said inputs being connected to the outputs of said first and second comparators, the output of said monitor circuit (S2) being connected to logical circuits (S3) responsive to the stationary value and to transitions of the output signal from said monitor circuit gate (S2) said reset signal being applied to said timing circuit to inhibit the same.

11. An apparatus as defined by claim 10, wherein said detector circuit includes an analog timing circuit (R30/C5) to prevent actuation by spurious pulses.

12. An apparatus as defined by claim 11, further including at least one gate connected behind said RC member, connected to the input of an output gate circuit (G3) for generating said reset pulse.

13. An apparatus as defined by claim 11, wherein the output of said sensor monitor circuit (S2) is connected directly to the input of a NOR gate (G3) whose output is said reset pulse, and wherein the output of said sensor monitor circuit (S2) is further connected to said timing member (R30/C5) for generating a predetermined delay time ($t_{min}$) prior to generation of said reset pulse, and wherein the output of said timing circuit is connected to an exclusive OR gate (G4), directly at one input and via an inverter (I2) at a second input, the output from said exclusive OR gate (G4) being connected to one input of said NOR gate (G3); whereby, when the threshold voltage of said detector circuit (G4, I2) is reached, said output NOR gate (G3) generates said reset pulse.

14. An apparatus as defined by claim 5, wherein said detector circuit includes a timing member (R30/C5) connected between the output of an exclusive OR gate (G10) whose inputs are connected to said first and second comparators, and one input of an exclusive OR gate (G12) the other input of which receives a constant voltage, and the output of which is applied to one input of a second exclusive OR gate (G13) another input of which is connected to said timing member (R30/C5), there being connected to the output of said second exclusive OR gate (G13) a further exclusive OR gate (G11) via a diode (D7), at a first input, which is also connected via a diode (D6) to the output of said exclusive OR gate (G10).

15. An apparatus as defined by claim 5, further comprising switching means (K1) actuated by the accelerator pedal of the engine when said engine is idling, for generating a reset pulse to be applied to said timing circuit via a supplementary NOR gate (ZG1).

16. An apparatus as defined by claim 5, wherein said timing circuit is a binary counter having an input (E1) for receiving a fixed clock frequency and a reset input ($E_R$) for receiving a reset pulse from a transition detector (S3) within said detector circuit, said timing circuit generating a logical signal for said controller after the expiration of a predetermined amount of time ($t_{max}$).

17. An apparatus as defined in claim 16, further including a NOR gate (G1) for receiving said clock pulse train prior to application to said counter, a second input of said NOR gate (G1) being connected to the output of said timing circuit.

18. An apparatus as defined by claim 5, wherein said timing circuit has a plurality of counter outputs (Q7,Q8,Q9), respectively connected to diodes (D10,D11,D12), the anodes of which are joined and fed to an amplifier to generate said reset pulse; whereby closed-loop control takes place between an average control value and the maximum value indicated by the prevailing signal from said oxygen sensor.

* * * * *